US006341850B1

(12) United States Patent
Sakai

(10) Patent No.: US 6,341,850 B1
(45) Date of Patent: Jan. 29, 2002

(54) INK JET RECORDING HEAD

(76) Inventor: Shinri Sakai, c/o Seiko Epson Corporation 3-5, Owa 3-chome, Suwa-shi, Nagano-ken 392-8502 (JP)

( * ) Notice: Subject to any disclaimer, the term of this patent is extended or adjusted under 35 U.S.C. 154(b) by 0 days.

(21) Appl. No.: 09/091,554

(22) PCT Filed: Oct. 28, 1997

(86) PCT No.: PCT/JP97/03916

§ 371 Date: Nov. 9, 1998

§ 102(e) Date: Nov. 9, 1998

(87) PCT Pub. No.: WO98/18632

PCT Pub. Date: May 7, 1998

(30) Foreign Application Priority Data

Oct. 28, 1996 (JP) ..... 8-285698

(51) Int. Cl.[7] ..... B41J 2/045
(52) U.S. Cl. ..... 347/70
(58) Field of Search ..... 347/70, 71, 72, 347/54

(56) References Cited

U.S. PATENT DOCUMENTS 5,684,520 A * 11/1997 Morikoshi et al. ..... 347/70
5,825,121 A * 10/1998 Shimada ..... 347/68 X

FOREIGN PATENT DOCUMENTS

JP 5-504740 7/1993 ..... B41J/2/16
JP 5-286131 11/1993 ..... B41J/2/045
JP 6-112550 4/1994 ..... H01L/41/24
JP 6-297720 10/1994 ..... B41J/2/16
JP 7-246705 9/1995 ..... B41J/2/045
JP 8-252914 * 10/1996

OTHER PUBLICATIONS

International Search Report.

* cited by examiner

*Primary Examiner*—Benjamin R. Fuller
*Assistant Examiner*—C Dickens
(74) *Attorney, Agent, or Firm*—Sughrue Mion, PLLC

(57) ABSTRACT

The object of the present invention is to provide a high-density ink-jet recording head provided with high resolution using thin film technique by preventing the characteristic of the displacement of a diaphragm from being deteriorated by the tension of the diaphragm, preventing the warp of a substrate from deteriorating the reliability and uniformity and preventing the looseness of the diaphragm from peeling a PZT film and from causing a failure of jetting.

The above ink-jet recording head is constituted so that the tension of the diaphragm in which a silicon oxide film (50) with negative tension and a lower electrode film (60) with positive tension are combined is substantially zero or negative and tension obtained by adding the tension of a piezoelectric film (70) with positive tension to the tension of the diaphragm is positive.

19 Claims, 7 Drawing Sheets

INK JET RECORDING HEAD

BACKGROUND OF THE INVENTION

1. Field of the Invention

The present invention relates to an ink-jet recording head used for an ink-jet recording device. The present invention relates to an ink-jet recording head provided with means for pressurizing an ink chamber using a piezoelectric element as means for energizing ink.

2. Description of the Related Art

For prior art related to the present invention, technique disclosed in U.S. Pat. No. 5,265,315 and Japanese published unexamined patent application No. Hei5-504740 can be given.

In such prior art, after a silicon oxide film is formed on a monocrystalline silicon substrate by thermal oxidation so that the film is 2500 Å thick, a lower electrode layer made of aluminum, nickel, chromium or platinum and others is formed so that the lower electrode film is 0.2 μm thick, next lead zirconate titanate (PZT) which is a piezoelectric substance is formed by sol-gel transformation so that it is 2 to 10 μm thick, further after an upper electrode film is laminated, and a through hole in the direction of the thickness of the silicon substrate to be an ink chamber is formed from the rear of the silicon substrate by etching.

To realize the enhancement of resolution and the speedup of printing respectively required for a printer currently, the size of an ink chamber is required to be reduced and simultaneously, a large number of ink chambers are required to be arranged in high density. To obtain required characteristics, miniaturizing an ink chamber, a diaphragm and a piezoelectric film are required to be simultaneously thinned.

If the thickness of a diaphragm and a piezoelectric film is a few μm or less, a method of baking a piezoelectric film after a thin film is sequentially laminated on a substrate and forming an ink chamber afterward is effective for their manufacturing method as described above in relation to the prior art.

However, if a diaphragm and a piezoelectric film are formed according to the above process and constitution, a lower electrode film tries to contract remarkably in the heat treatment of a PZT film and large positive residual stress is accumulated.

The tension by residual stress of the lower electrode film is tensile force and is larger than the tension by residual stress of another film. Therefore, the tension of the diaphragm remarkably increases the rigidity of the diaphragm as a drumhead strongly strained.

The effect of such tension of a diaphragm is not particularly a problem in a conventional type ink-jet recording head in which a diaphragm is formed so that it is 10 μm or thicker. The reason is as follows: For the rigidity of a conventional type thick diaphragm, flexural rigidity dominates and is in proportion to the third power of the thickness of the diaphragm. In the meantime, the rigidity by the tension of the diaphragm is in proportion to the first power of the thickness. Therefore, as a diaphragm becomes thick, flexural rigidity rapidly becomes large and the effect of the tension of the diaphragm relatively rapidly becomes small.

There is a problem that as piezoelectric displacement when a PZT film is driven operates upon the tension of a diaphragm, surplus energy is required and the efficiency of displacement for driving voltage is remarkably deteriorated.

Further, there is a problem that the tension of the diaphragm on a substrate warps the substrate, a failure of joining occurs when the substrate is joined to another substrate and a yield is remarkably deteriorated.

There is also a problem that even if joining is normally done, dispersion occurs in the tension of the diaphragm in the substrate, the characteristic of plural ink chambers becomes uneven and the quality of printing is deteriorated.

Conversely, there is a problem that if the tension of the diaphragm is the tension of compression, the diaphragm is loosened or buckled and the jetting of an ink droplet is unstable. Further, there is a problem that peeling is caused in an interface between the lower electrode film and the PZT film.

SUMMARY OF THE INVENTION

The present invention is made to solve these problems and the object is to provide a reliable ink-jet recording head provided with high resolution.

To achieve the above object, the present invention is characterized in that in an ink-jet recording head provided with plural ink chambers included inside a substrate and respectively partitioned by side walls, a diaphragm which is formed on the surface of the substrate, which seals one side of the ink chamber and at least the upper surface of which acts as a lower electrode and a piezoelectric active part provided with a piezoelectric film arranged on the diaphragm corresponding to the ink chamber and an upper electrode formed on the piezoelectric film, the above diaphragm is constituted as a laminated film provided with at least two layers of a layer with positive stress and a layer with negative stress, the tension of the diaphragm is substantially zero or negative because of the above stress of the diaphragm, and tension obtained by adding the tension of the above piezoelectric film to the tension of the diaphragm is positive.

The present invention is also characterized in that in an ink-jet recording head provided with plural ink chambers included inside a substrate and respectively partitioned by side walls, a diaphragm which is formed on the surface of the substrate, which seals one side of the ink chamber and on the lower surface of which an upper electrode is provided and a piezoelectric film arranged on the diaphragm corresponding to the ink chamber and held between the lower electrode and the upper electrode, the above diaphragm is constituted as a laminated film provided with at least two layers of a layer with positive stress and a layer with negative stress, the tension of the diaphragm is substantially zero or negative because of the above stress and tension obtained by adding the respective tension of the piezoelectric film and the upper electrode to the tension of the diaphragm is positive.

In a favorable embodiment, the above diaphragm may be also provided with a silicon oxide layer formed by oxidizing the surface of a monocrystalline silicon substrate and a metal layer to be the above lower electrode laminated on the silicon oxide layer and plural ink chambers respectively partitioned by side walls may be also formed inside the above monocrystalline silicon substrate.

It is desirable that the metal layer to be the lower electrode is a platinum layer formed on the silicon oxide layer directly or via an intermediate layer for example and relationship between the silicon oxide layer and the platinum layer is as follows:

(Thickness of lower electrode film)/(Thickness of silicon oxide film)$\leqq$0.5.

Further, the above diaphragm may be also provided with a thin film part thinner than the thickness of the diaphragm in a part corresponding to the above piezoelectric active part in at least a part of an area along the periphery of the ink chamber around the piezoelectric active part.

The above diaphragm may be also provided with a silicon oxide layer formed by oxidizing the surface of a monocrystalline silicon substrate and a metal layer to be the lower electrode laminated the silicon oxide layer and at least a part in the direction of the thickness of the lower electrode may be also removed in the above thin film part.

The above thin film part is formed on both sides in the direction of the width of the piezoelectric active part for example.

According to the present invention, the tension of the diaphragm is kept the tension of zero or compression by combining positive stress and negative stress, no tensile force of the diaphragm which remarkably deteriorates the quantity of displacement when a PZT film is driven is generated and the warp of the substrate can be also simultaneously reduced. As positive tension (tensile force) is generated inside a laminated film when positive stress by the contraction of the piezoelectric film is further combined, the looseness of the diaphragm and the peeling of the PZT film are inhibited.

According to the above present invention, the characteristic of the displacement of the diaphragm by the driving of a piezoelectric element can be prevented by the tension of members constituting the diaphragm from being deteriorated. Therefore, ability for jetting an ink droplet can be sufficiently enhanced, keeping driving voltage low. The deterioration of the characteristic by joining and the deterioration of a yield by a failure of joining can be reduced by reducing the quantity of the warp of the substrate until it is small enough. Further, as no looseness is also caused on the diaphragm if the tension of the diaphragm is prevented from being tensile force, the jetting of an ink droplet is prevented from being unstable and peeling is prevented from being caused in an interface between the lower electrode film and the PZT film, the performance of the recording head can be enhanced as much as possible, securing uniformity and reliability and an ink-jet recording head in high density provided with high resolution using thin film technique can be supplied.

DESCRIPTION OF THE PREFERRED EMBODIMENTS

The present invention will be described in detail based upon an embodiment below.

First Embodiment

Figure 1:
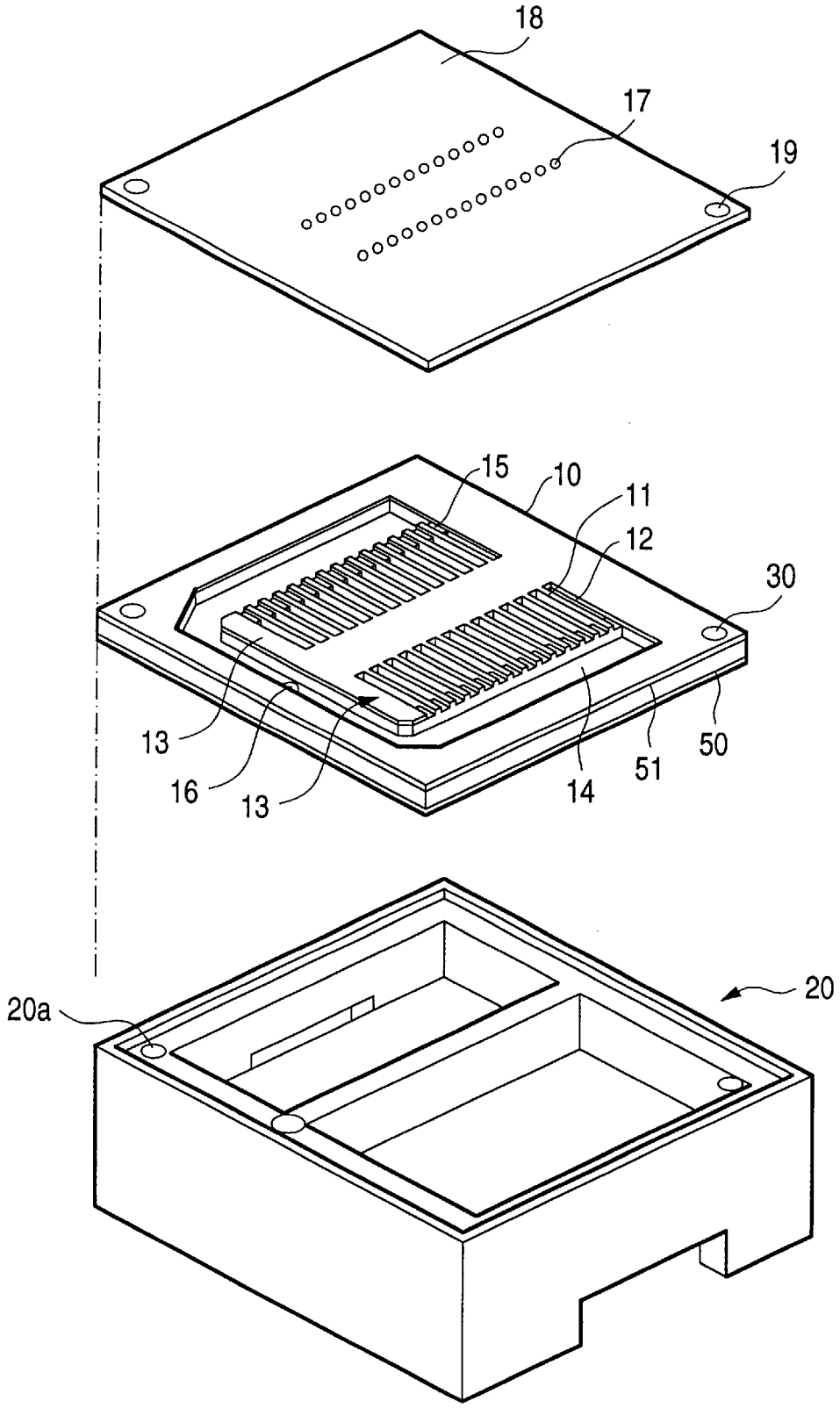
FIG. 1 is an exploded perspective view showing an ink-jet recording head equivalent to a first embodiment of the present invention.
Figure 2:
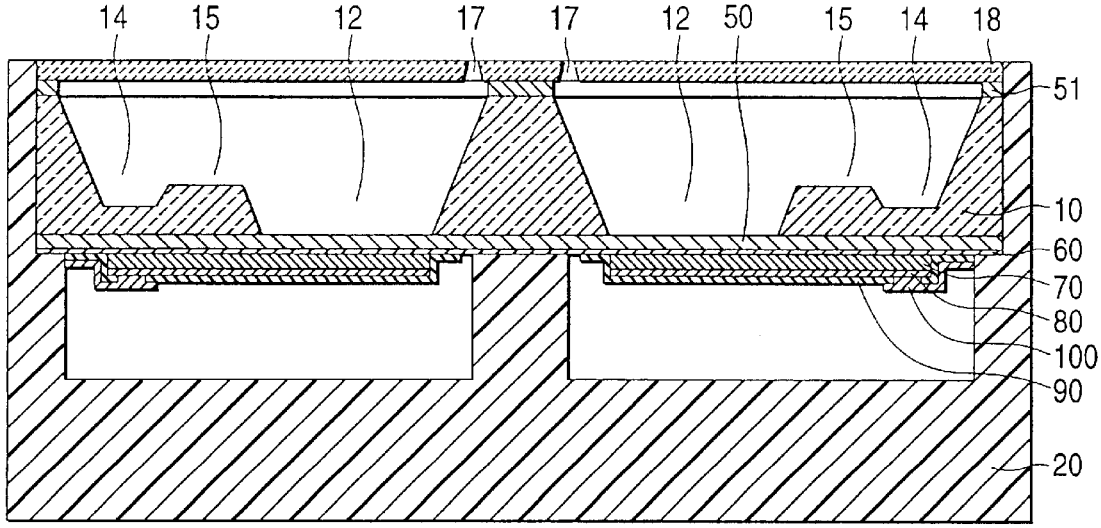
FIGS. 2(*a*) and 2(*b*) are sectional views showing the ink-jet recording head equivalent to the first embodiment of the present invention.
Figure 2:
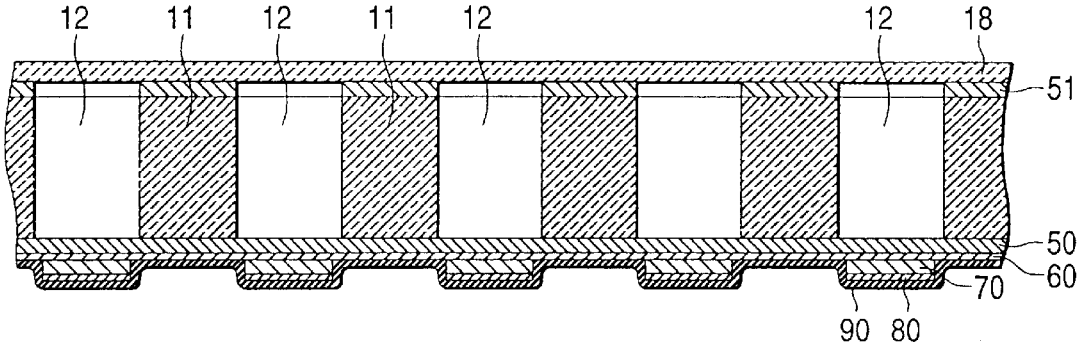

FIG. 1 is an assembly perspective drawing showing an ink-jet recording head equivalent to an embodiment of the present invention and FIGS. 2 show the sectional structure in the longitudinal direction and cross-sectional direction of one ink chamber in the ink-jet recording head.

As shown in FIGS. 2(*a*) and 2(*b*), a passage forming substrate 10 made of a monocrystalline silicon substrate is provided with the surface orientation of (110) in this embodiment, normally a monocrystalline silicon substrate approximately 150 to 300 $\mu$m thick is used, desirably a monocrystalline silicon substrate approximately 180 to 280 $\mu$m thick and preferably approximately 220 $\mu$m thick is suitable. The reason is that array density can be enhanced, keeping the rigidity of a partition between adjacent ink chambers.

One face of the passage forming substrate 10 is open and on the other surface, a diaphragm is constituted by a silicon oxide film 50 made of silicon dioxide formed by thermal oxidation beforehand with the thickness of 1 to 2 $\mu$m and a lower electrode film 60. A piezoelectric film 70 narrower than the width of an ink chamber 12 is laminated on the diaphragm equivalent to a part of the ink chamber 12 and an upper electrode film 80 is formed on the piezoelectric film 70.

In the meantime, on the side of the open face of the passage forming substrate 10, the ink chamber 12 partitioned by plural partitions 11 is formed at the same pitch in a row 13 by anisotropic etching as described later. Two rows 13 composed of ink chambers 12 are provided, and a reservoir 14 arranged in the shape of a letter C so that the reservoir surrounds the two rows of ink chambers in three directions and ink supply ports 15 each of which connects each ink chamber 12 and the reservoir 14 under fixed fluid resistance are formed around the two rows of ink chambers 12. Each ink supply port 15 communicating with one end of each ink chamber 12 is formed so that each ink supply port is shallower than each ink chamber 12. That is, the ink supply port 15 is formed by etching the monocrystalline silicon substrate halfway in the direction of the thickness (half etching). The above half etching is enabled by adjusting etching time.

A reference hole 30 for aligning the passage forming substrate 10 is respectively formed at the diagonal two corners of the passage forming substrate 10.

A nozzle plate 18 through which nozzle apertures 17 each of which communicates with the ink chamber 12 at the opposite end of the ink chamber 12 where the ink supply port is connected; and is fixed on the side of the open face of the passage forming substrate 10 via an adhesive, a thermic welding film or others. The nozzle plate 18 is a plate made of glass ceramics or rust-resistant steel and others with the thickness of 0.1 to 1 mm for example and the coefficient of linear thermal expansion of 2.5 to 4.5[$\times 10^{-6}$/° C.] for example at 300° C. or less. The nozzle plate 18 covers one surface of the passage forming substrate 10 overall with one surface and also functions as a reinforcing plate for protecting the passage forming substrate 10 from impact and external force. A reference hole 19 is formed through the nozzle plate 18 respectively in a position corresponding to the reference hole 30 of the passage forming substrate 10.

The size of the ink chamber 12 for applying pressure for jetting an ink droplet to ink and the size of the nozzle aperture 17 for jetting an ink droplet are optimized according to the quantity of a jetted ink droplet, jetting speed and jetting frequency. For example, if 360 ink droplets are to be recorded per inch, nozzle apertures 17 a few tens μm in diameter are required to be formed precisely.

In the meantime, as described above, the lower electrode film 60 with the thickness of approximately 0.5 μm for example, the piezoelectric film 70 with the thickness of approximately 1 μm for example and the upper electrode film 80 with the thickness of approximately 0.1 μm for example are laminated on the silicon oxide film 50 on the reverse side to the open face of the passage forming substrate 10 in a process described later and constitute a piezoelectric element. As described above, a piezoelectric element is independently provided every ink chamber 12 in an area opposite to each ink chamber 12 on the silicon oxide film 50, in this embodiment, the lower electrode film 60 functions as a common electrode for piezoelectric elements and the upper electrode film 80 functions as an individual electrode for each piezoelectric element, however, these may be also inverted for convenience of a driving circuit and wiring and a piezoelectric active part provided with the piezoelectric film 70 and the upper electrode film 80 is formed every ink chamber 12.

In this embodiment, the length in the direction of the array of the ink chamber 12 is set to 75 μm, the length in the direction of the depth is set to 2 μm, and the length in the direction of the array of the piezoelectric film 70 formed over the ink chamber 12 is set to 60 μm. Pitch between the ink chambers 12 in the direction of the array is set to 141 μm in case 180 nozzles are arranged per inch and 64 ink chambers are arranged in a row. That is, as the piezoelectric active part composed of the piezoelectric film 70 and the upper electrode film 80 is located only over the ink chamber 12 and no piezoelectric film 70 is provided in a part in which no ink chamber is provided in the direction of the array, the same quantity of displacement can be obtained at small voltage when voltage is applied and the diaphragm corresponding to the ink chamber 12 is deformed.

Such passage forming substrate 10 and nozzle plate 18 are fixed into a fixing member 20 provided with a concave portion for holding these. Reference holes 20*a* are also formed in a position corresponding to the reference hole 30 of the passage forming substrate 10 in the fixing member 20.

An insulating layer 90 provided with electric insulation is formed so that it covers at least the periphery of the upper surface of each upper electrode film 80 and the side of each piezoelectric film 70. It is desirable that the insulating layer 90 is formed by material which enables formation by a method of forming a film and reshaping by etching, for example silicon oxide, silicon nitride and organic material and preferably photosensitive polyimide low in rigidity and excellent in electric insulation.

Figure 3:
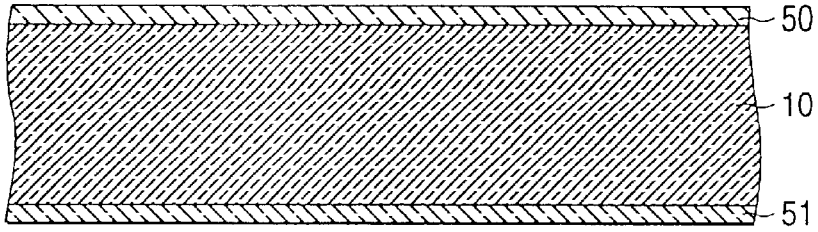
FIGS. 3(*a*) to 3(*e*) show a thin film manufacturing process in the first embodiment of the present invention.
Figure 3:
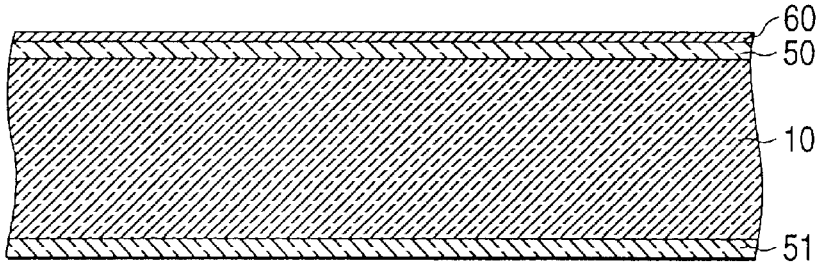
Figure 3:
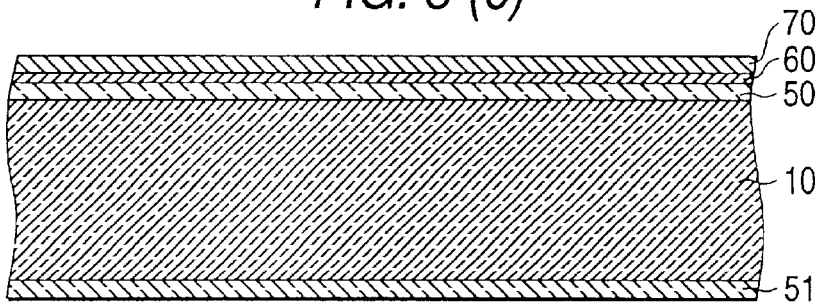
Figure 3:
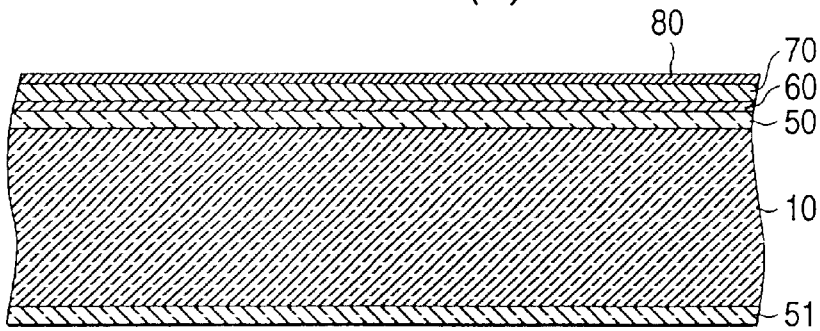
Figure 3:
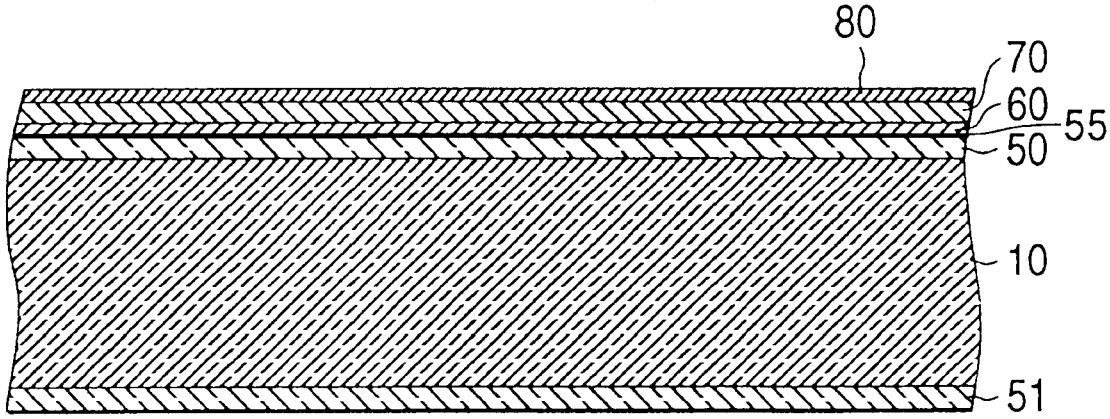

Referring to FIGS. 3(*a*)–3(*e*) and 4(*a*)–4(*c*), a process in which the piezoelectric film 70 and others are formed on the passage forming substrate 10 made of a monocrystalline silicon substrate will be described below.

As shown in FIG. 3(*a*), first, a wafer 220 μm thick with the surface orientation of (110) to be the passage forming substrate 10 is thermally oxidized at the temperature of approximately 1200° C. in wet and silicon oxide films 50 and 51 are formed on both sides of the passage forming substrate 10 at a time.

Next, as shown in FIG. 3(*b*), the lower electrode film 60 is formed by sputtering. For the material of the lower electrode film 60, platinum (Pt) and others are favorable. Because the piezoelectric film 70 described later and formed by sputtering and sol-gel transformation is required to be baked and crystallized at the temperature of approximately 600 to 1000° C. in the atmosphere of the air or oxygen after forming. That is, the material of the lower electrode film 60 is required to keep conductivity in such atmosphere of oxygen of high temperature and particularly, if PZT is used for the material of the piezoelectric film 70, it is desirable that the change of conductivity by the diffusion of PbO is small and Pt is favorable for the reason.

In this embodiment, titanium, titanium oxide and titanium are sequentially formed by a few tens Å between the silicon oxide film 51 and the lower electrode film 60 as an intermediate layer 55 as shown in FIG. 3(*e*) for enhancing adhesion strength. The titanium layer, the titanium oxide layer and the titanium layer which are the intermediate layers and the lower electrode film 60 are sequentially formed by D.C. sputtering and the titanium oxide layer of them is formed by reactive sputtering in the atmosphere of oxygen of 10%.

Therefore, in this embodiment, the diaphragm is composed of the silicon oxide film 50, the intermediate layers and the lower electrode film 60. An intermediate layer is not necessarily required to be provided and the diaphragm may be also composed of only the silicon oxide film 50 and the lower electrode film 60.

Next, as shown in FIG. 3(*c*), the piezoelectric film 70 is formed. Sputtering may be also used for forming the piezoelectric film 70, however, in this embodiment, so-called sol-gel transformation in which the piezoelectric film 70 made of metallic oxide is obtained by transforming so-called sol in which a metallic organic substance is dissolved and dispersed in a solvent to gel by applying and drying and further, baking at high temperature is used.

The material of the piezoelectric film 70 formed by sol-gel transformation is homogeneous sol obtained by adding polypropylene glycol the average molecular weight of which is 400 to metallic oxide in the sol by 30 percent by weight and stirring it sufficiently after lead acetate of 0.105 mole, zirconium acetylacetonate of 0.045 mole, magnesium acetate of 0.005 mole and acetic acid of 30 ml respectively heated up to 100° C. and dissolved are cooled up to room temperature, titanium tetraisopropoxid of 0.040 mole and pentaethoxyniobium of 0.010 mole are dissolved and added in/to ethyl cellosolve of 50 ml and acetylacetone is added by 30 ml and stabilized. Sol processed on the lower electrode film 60 is applied by spin, is temporarily baked at the temperature of 400° C., an amorphous porous gel thin film is formed and the above application and temporary baking are repeated until the piezoelectric film has required thickness. Next, pre-annealing is done by heating the piezoelectric film up to 650° C. for five seconds in the atmosphere of oxygen using a rapid thermal annealing (RTA) method and keeping it for one minute. Further, the piezoelectric film is annealed by heating it up to 900° C. in the atmosphere of oxygen using the RTA method and keeping it for one minute and a final PZT piezoelectric thin film is obtained. When the materials of the piezoelectric film obtained as described above were measured, they showed excellent characteristics that the dielectric constant was 2000 and the coefficient of strain by piezoelectricity d31 was −150 pC/N.

Next, as shown in FIG. 3(*d*), platinum (Pt) is formed so that it is 200 Å thick by D.C. sputtering and the upper electrode film 80 is formed. The material of the upper electrode film 80 has only to be conductive material and many metals such as Al, Au and Ni in addition to Pt, conductive oxide and others may be used.

Figure 4:
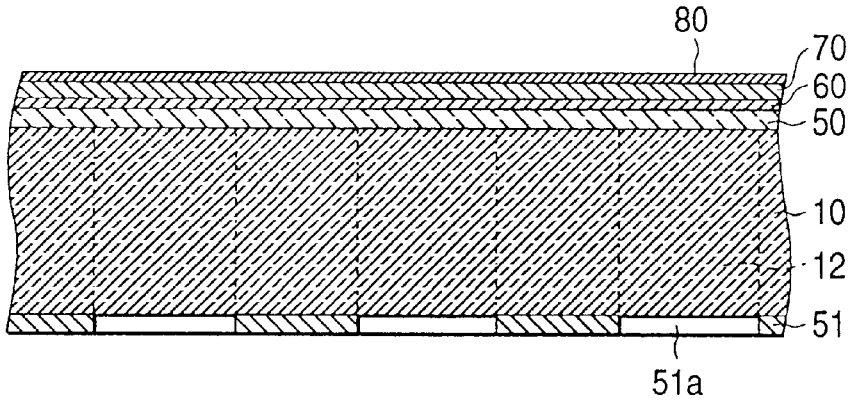
FIGS. 4(*a*) to 4(*c*) show the thin film manufacturing process in the first embodiment of the present invention.
Figure 4:
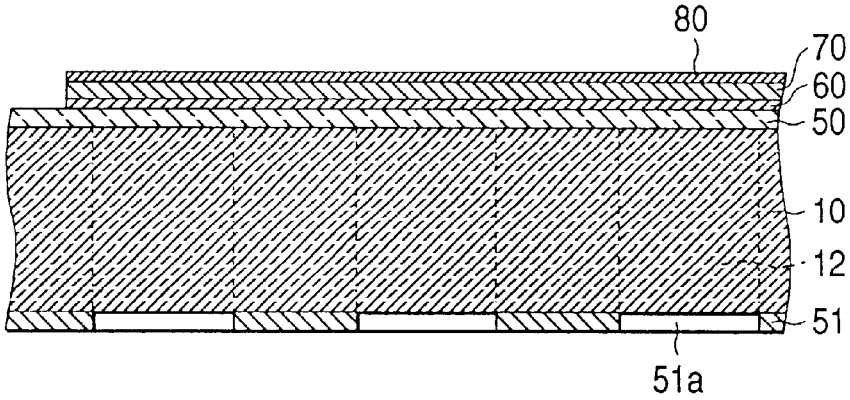
Figure 4:
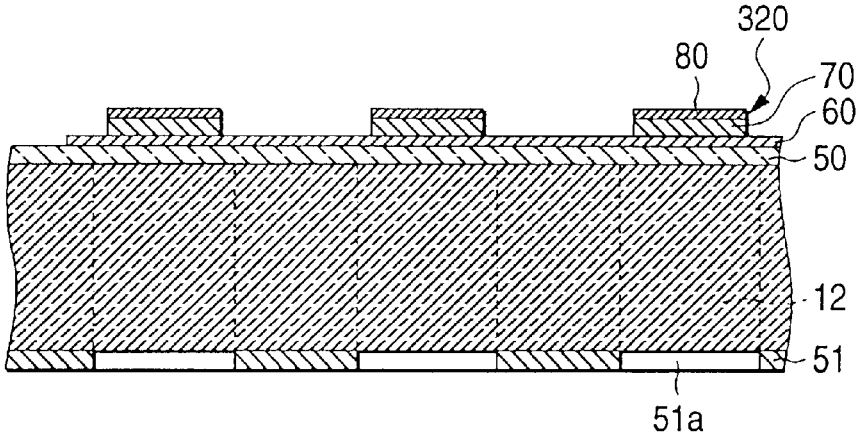

Next, as shown in FIGS. 4(*a*) to 4(*c*), the lower electrode film 60, the piezoelectric film 70 and the upper electrode film 80 are patterned.

First, as shown in FIG. 4(*a*), a photoresist is formed on the silicon oxide film 51, an opening is provided, the silicon oxide film 51 is patterned in the aqueous solution of hydrofluoric acid and ammonium fluoride and the opening 51*a* is formed. The direction of the depth of the opening 51*a*, that is, a direction perpendicular to the surface of the drawing is equivalent to the direction of <112> of the passage forming substrate 10.

Next, as shown in FIG. 4(*b*), the lower electrode film 60, the piezoelectric film 70 and the upper electrode film 80 are etched together and the whole pattern of the lower electrode film 60 is formed. Next, as shown in FIG. 4(*c*), only the piezoelectric film 70 and the upper electrode film 80 are etched and the piezoelectric active part 320 is patterned.

After the lower electrode film 60 and others are patterned as described above, it is desirable that an insulating layer 90 provided with electric insulation is formed so that the insulating layer covers at least the periphery of the upper surface of each upper electrode film 80 and the respective sides of the piezoelectric film 70 and the lower electrode film 60 as shown in FIGS. 2(*a*) and 2(*b*).

A contact hole 90*a* is formed in a part of the insulating film 90 which covers the upper surface of the part corresponding to one end of each piezoelectric active part 320. A lead electrode 100 one end of which is connected to each upper electrode film 80 via the contact hole 90*a* and the other end of which is extended to a connecting terminal is formed.

Figure 5:
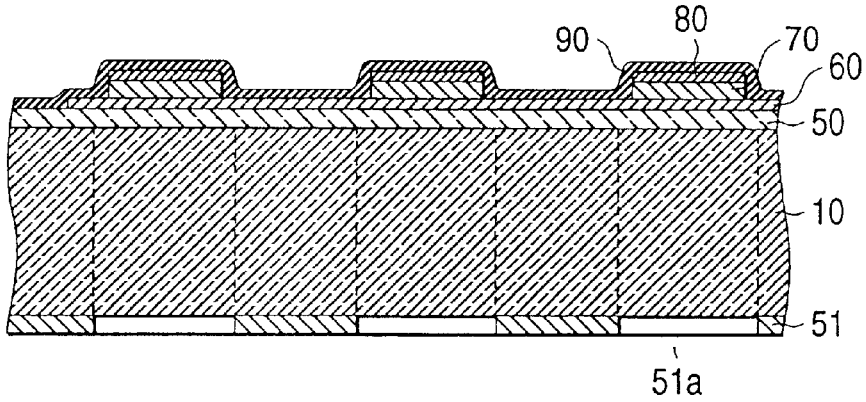
FIGS. 5(*a*) to 5(*c*) show the thin film manufacturing process in the first embodiment of the present invention.
Figure 5:
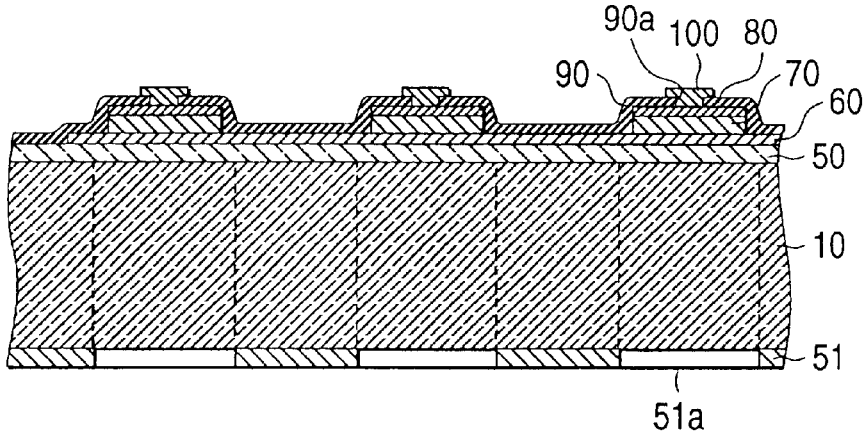
Figure 5:
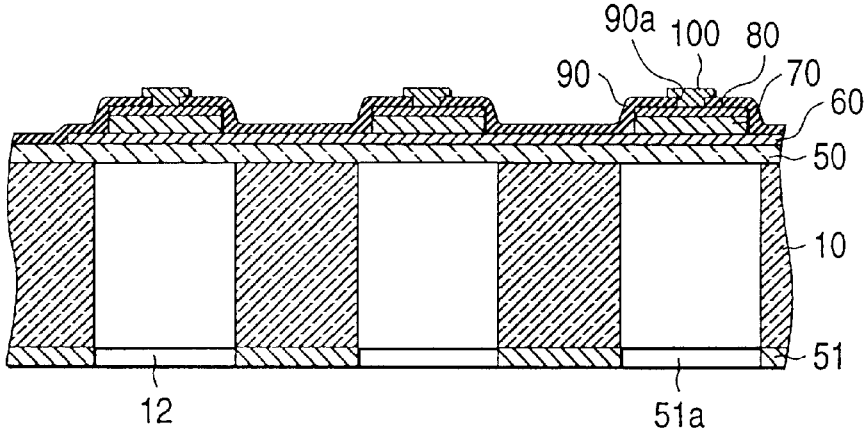

FIGS. 5(*a*)–5(*c*) show a process for forming the above insulating layer and the above lead electrode.

First, as shown in FIG. 5(*a*), the insulating layer 90 is formed so that it covers the periphery of the upper electrode film 80 and the respective sides of the piezoelectric film 70 and the lower electrode film 60. Negative photosensitive polyimide is used for the insulating layer 90 in this embodiment.

Next, as shown in FIG. 5(*b*), the contact hole 90*a* is formed in a part corresponding to the vicinity of the end on the side of the ink supply port of each ink chamber 12 by patterning the insulating layer 90. The contact hole 90*a* has only to be provided in a part corresponding to the piezoelectric active part 320 and for example, may be also provided in the center and at the end on the side of a nozzle.

Next, the lead electrode 100 is formed by patterning an electric conductor after the electric conductor such as Cr—Au is formed overall.

The process for forming films is described above. After the films are formed as described above, the passage forming substrate 10 is anisotropically etched from the opening 51*a* of the silicon oxide film 51 by dipping in the aqueous solution of potassium hydroxide of 80° C. as shown in FIG. 5(*c*), etching is continued until the silicon oxide film 50 is exposed and the ink chamber 12 is formed.

In the above anisotropic etching, as the surface orientation of the passage forming substrate 10 is (110) and further, the direction of the depth of the opening 51*a* is <112> as described above, the surface orientation of the side wall forming the side in the direction of the depth of the ink chamber 12 can be (111).

As the ratio in etching speed of the surface (110) and the surface (111) of monocrystalline silicon is approximately 300 to 1 if the aqueous solution of potassium hydroxide is used and a groove 220 $\mu$m deep which is equivalent to the thickness of the passage forming substrate can be formed so that the width is approximately 1 $\mu$m by side etching, the ink chamber 12 can be precisely formed.

As for such an ink-jet recording head, multiple chips are simultaneously formed on one wafer by the above series of forming films and anisotropic etching and after the process is finished, the wafer is divided into each passage forming substrate 10 equivalent to one chip and shown in FIG. 1. The divided passage forming substrate 10 is sequentially bonded to the nozzle plate 18 and the fixing member 20 and integrated with them to be an ink-jet recording head.

In the ink-jet recording head constituted as described above, ink is taken in from an ink inlet 16 connected to external ink supply means not shown and after the inside from the reservoir 14 to the nozzle aperture 17 is filled with ink, pressure in the ink chamber 12 is increased and an ink droplet is jetted from the nozzle aperture 17 by applying voltage between the lower electrode film 60 and the upper electrode film 80 via the conductive pattern 100 according to a recording signal from an external driving circuit not shown and deforming the silicon oxide film 50 and the piezoelectric film 70.

The tension of the silicon oxide films 50 and 51, the lower electrode film 60 and the piezoelectric film 70 in the above ink-jet recording head will be described below.

As the silicon oxide film is formed by thermal oxidation, it is expanded on the silicon substrate and negative stress is generated. That is, the silicon oxide film receives compressive force from the silicon substrate and conversely, the silicon substrate receives tensile force from the silicon oxide film. As the compressive tension of the silicon oxide film equally acts on both sides of the silicon substrate, the silicon substrate is never warped.

In the meantime, the lower electrode film and the piezoelectric film are contracted in a process of heat treatment at high temperature in which high temperature lowers and have positive stress over the silicon substrate at ordinary temperature. That is, the lower electrode film and the piezoelectric film receive tensile force from the silicon substrate and conversely, the silicon substrate receives compressive force from the lower electrode film and the piezoelectric film. As the silicon substrate is thick enough when it is compared with another film, the silicon substrate is described below as an object on which tension acts. The silicon substrate in which films are laminated is warped by tensile force which operates upon the lower electrode film and the piezoelectric film with the surface of the lower electrode film or the piezoelectric film concave.

The tension or the stress of each film is measured as follows:

The silicon substrate is warped by the tension, however, if the radius of curvature of the warp at this time is R, relationship between the radius of curvature R and the tension T or the stress σ of the thin film is expressed by the following relational expression.

$$\frac{1}{R} = \frac{6d(1-\nu_s)}{E_s D^2}\sigma = \frac{6(1-\nu_s)}{E_s D^2}T$$

In the above expression, "d" denotes the thickness of the thin film, "D" denotes the thickness of the silicon substrate, "$v_s$" denotes Poisson's ratio of the silicon substrate and "$E_s$" denotes Young's modulus of the silicon substrate.

As the elastic constant of silicon is anisotropic in measuring the quantity of a warp, a sample in the shape of a strip along specific crystal orientation is used and in calculation, Young's modulus and Poisson's ratio in the direction are used.

The tension of the silicon oxide film 50 is obtained from the quantity of a warp after the silicon oxide film 51 on one surface of the silicon substrate 10 is removed by etching.

The tension of the piezoelectric film 70 is obtained from the change of the quantity of a warp before and after the piezoelectric film 70 is removed by etching.

The tension of the lower electrode film 60 is obtained from the quantity of a warp after the piezoelectric film 70 is removed. At this time, the silicon oxide film is required to be formed on both sides of the silicon substrate.

To obtain stress from the tension obtained as described above, Young's modulus of each film is required. Young's modulus is required to be measured carefully so that stress has no effect. As in measurement using a twin tong or measurement using a film the periphery of which is fixed, different values are measured because of tension, Young's modulus is obtained based upon the characteristics of a load and flexure using a cantilever.

(First constitution of films)

Table 1 shows first constitution of films according to the present invention.

TABLE 1

| | Thickness (nm) | Young's modulus (Pa) | Stress (Pa) | Tension (N/m) |
|---|---|---|---|---|
| Silicon oxide film | 1000 | $6 \times 10^{10}$ | $-2.2 \times 10^{8}$ | −216 |
| Platinum lower electrode film | 500 | $1.5 \times 10^{11}$ | $3.9 \times 10^{8}$ | 195 |
| PZT piezo-electric film | 1000 | $5 \times 10^{10}$ | $1.5 \times 10^{8}$ | 150 |

In the above constitution, (thickness of lower electrode film)/(thickness of silicon oxide film) is set to 0.5. The stress of the lower electrode film and the silicon oxide film slightly varies depending upon the thickness of the respective films and the method of heat treatment, however, the respective tension of the lower electrode film 60 and the silicon oxide film 50 can be approximately matched by setting the film parameter to 0.5. Therefore, the tension of the diaphragm is substantially zero. The warped quantity of the substrate in the direction of the array of ink chambers 12 is 3 $\mu$m in a range in which the ink chambers 12 are arranged and the diaphragm is concave. In this embodiment, the silicon substrate 10, the nozzle plate 18 and others are bonded by an adhesive, however, no failure of bonding occurs in the quantity of the warp. The characteristic of the displacement of the diaphragm after bonding is also unchanged.

The quantity of displacement when the voltage of 10 V is applied to a piezoelectric element according to the above constitution is 110 nm. In the meantime, the quantity of displacement when the voltage of 10 V is applied to constitution in which the silicon oxide film 50 opposite to the ink chamber 12 is removed by etching in the above constitution is 80 nm. As a result of measuring the rigidity (compliance) of the diaphragm, the change of the rigidity before and after the silicon oxide film 50 is removed is slight. Generally, when the silicon oxide film is removed, the flexural rigidity of the diaphragm is reduced and the quantity of displacement by the application of voltage is expected to be increased by the quantity. In this embodiment, as the tension and the thickness are set so that the tension is large and the thickness is thin, strong tensile force operates upon the diaphragm because of the positive tension of the lower electrode film 60 if the silicon oxide film with negative tension is removed and the tension sets off the deteriorated quantity of the flexural rigidity. The efficiency of the displacement of the diaphragm by the piezoelectric element can be remarkably enhanced by constituting so that the tension of the diaphragm is substantially zero or negative as in the above constitution.

(Second constitution of films)

Table 2 shows second constitution of films according to the present invention.

TABLE 2

| | Thickness (nm) | Young's modulus (Pa) | Stress (Pa) | Tension (N/m) |
|---|---|---|---|---|
| Silicon oxide film | 1500 | $6 \times 10^{10}$ | $-1.9 \times 10^{8}$ | −288 |
| Platinum lower electrode film | 400 | $1.5 \times 10^{11}$ | $3.9 \times 10^{8}$ | 156 |
| PZT piezo-electric film | 1000 | $5 \times 10^{10}$ | $1.5 \times 10^{8}$ | 150 |

In the above constitution, (thickness of lower electrode film)/(thickness of silicon oxide film) is set to 0.27. As the tension of the silicon oxide film is larger in an absolute value than the tension of the lower electrode film, negative tension operates as the diaphragm. When the tension of the PZT piezoelectric film is added to the tension of the diaphragm, the above tension becomes positive tension as a whole, the diaphragm is never loosened and an ink droplet can be normally and stably jetted. Even after an etching process for the silicon substrate 10, no peeling occurs.

The warped quantity of the substrate in the direction of the array of ink chambers 12 is substantially zero though the diaphragm is slightly concave by 1 $\mu$m in a range in which the ink chambers are arranged and no problem of bonding occurs.

The quantity of displacement when voltage of 10 V is applied to a piezoelectric element according to the above constitution is 120 nm and is increased by approximately 10%, compared with that in the first constitution. The rigidity (compliance) of the diaphragm is increased by 10% (is reduced by 10%), compared with that in the first constitution. Therefore, strong pressure can be generated at low driving voltage in the ink chamber and in total, the characteristics are enhanced more by 20% than in the first constitution.

(Third constitution of films)

Table 3 shows third constitution of films according to the present invention.

TABLE 3

| | Thickness (nm) | Young's modulus (Pa) | Stress (Pa) | Tension (N/m) |
|---|---|---|---|---|
| Silicon oxide film | 1500 | $6 \times 10^{10}$ | $-1.9 \times 10^{8}$ | −288 |
| Platinum lower electrode film | 400 | $1.5 \times 10^{11}$ | $3.9 \times 10^{8}$ | 156 |
| PZT piezo-electric film | 600 | $5 \times 10^{10}$ | $1.5 \times 10^{8}$ | 90 |

In the above constitution, the PZT piezoelectric film is thinned, compared with that in the second constitution. In the constitution, the negative tension of the silicon oxide film is stronger than the positive tension of the lower electrode film and the PZT piezoelectric film and the diaphragm is loosened. Though it may be difficult to verify the above looseness by a microscope and others, the jetting of an ink droplet becomes unstable and difference in the characteristic among the ink chambers 12 is increased. The peeling of a film may occur in an etching process for the silicon substrate 10 and a yield is deteriorated.

(Fourth constitution of films)

Table 4 shows fourth constitution of films according to the present invention.

TABLE 4

| | Thickness (nm) | Young's modulus (Pa) | Stress (Pa) | Tension (N/m) |
|---|---|---|---|---|
| Silicon oxide film | 500 | $6 \times 10^{10}$ | $-2.3 \times 10^{8}$ | −114 |
| Platinum lower electrode film | 500 | $1.5 \times 10^{11}$ | $3.9 \times 10^{8}$ | 195 |
| PZT piezo-electric film | 1000 | $5 \times 10^{10}$ | $1.5 \times 10^{8}$ | 150 |

In the above constitution, the silicon oxide film is thinned, compared with that in the first constitution and (thickness of lower electrode film)/(thickness of silicon oxide film) is set to 1. As the tension of the silicon oxide film is smaller in an absolute value than the tension of the lower electrode film, positive tension operates as the diaphragm. The warped quantity of the substrate in the direction of the array of ink chambers 12 is 9 $\mu$m in a range in which the ink chambers are arranged by the tension of the diaphragm and the diaphragm is concave. Because of the above warp, a partial failure of bonding occurs and a yield is deteriorated. As the quantity of a warp varies depending upon bonding, the tension of the diaphragm varies every ink chamber and dispersion in the quantity of the displacement and the rigidity is increased. Therefore, the quantity of jetted ink varies in the ink-jet recording head and the quality of printing is deteriorated.

In the above embodiment, the silicon oxide film and the platinum film are combined, however, another combination is also allowed.

Generally, if a second element (oxygen is equivalent in the above embodiment) is doped into the surface of the substrate and a film is formed, negative stress is generated in the film. Therefore, the similar effect can be also obtained in a film formed by doping boron and nitrogen into the surface of the silicon substrate in addition to the silicon oxide film.

A palladium film and a film including both palladium and platinum can be given in addition to the platinum film.

In the above embodiment, as the tension of the upper electrode film 80 is small enough, compared with the tension of another film, the effect is not considered, however, the tensile force of the upper electrode film 80 is increased by selecting the material, the thickness or a forming method of the upper electrode film 80, positive tension is obtained by adding the respective tension of the upper electrode film 80, the piezoelectric film 70 and the diaphragm and the similar effect can be obtained.

Second Embodiment

Figure 6:
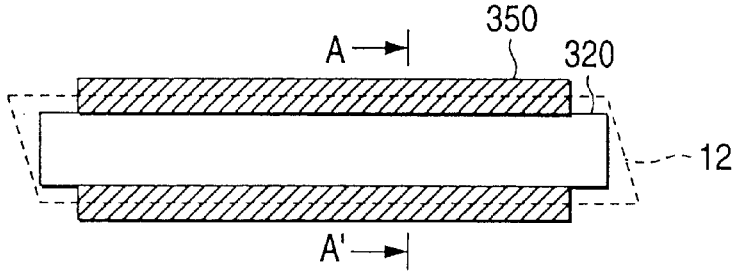
FIGS. 6(*a*) to 6(*c*) are sectional views showing the main part of an ink-jet recording head equivalent to a second embodiment of the present invention.
Figure 6:
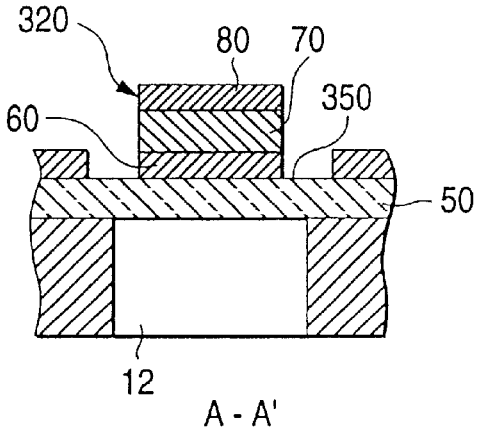
Figure 6:
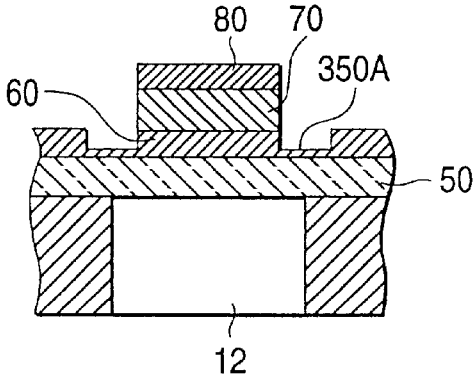

FIGS. 6(*a*) to 6(*c*) show a piezoelectric active part and a pressure generating chamber in an ink-jet recording head equivalent to a second embodiment of the present invention.

This embodiment is the same as the first embodiment except that a lower electrode film removed part 350 from which the lower electrode film 60 is removed is provided next to both sides in the direction of the width of a piezoelectric active part 320 composed of a piezoelectric film 70 and an upper electrode film 80.

The lower electrode film removed part 350 is formed by etching in the shape of a predetermined pattern after the upper electrode film 80 and the piezoelectric film 70 are patterned. As shown in FIG. 6(*a*), in this embodiment, a part in which the lower electrode film removed part 350 is provided is a part called an arm of a diaphragm, a part opposite to the vicinity of the periphery along both sides in the direction of the width of the ink chamber 12 and as shown in a section A—A in FIG. 6(*b*), the lower electrode film 60 on both sides of the piezoelectric active part 320 is removed.

The quantity of the displacement generated by applying voltage to the piezoelectric active part 320 can be increased by providing the lower electrode film removed part 350 as described above.

In this embodiment, the lower electrode film removed part 350 is formed by completely removing the lower electrode film 60, however, as shown in FIG. 6(*c*), a lower electrode film removed part 350A in which a part of the lower electrode film 60 is removed by half etching and others and a thin film is left may be also formed.

Figure 7:
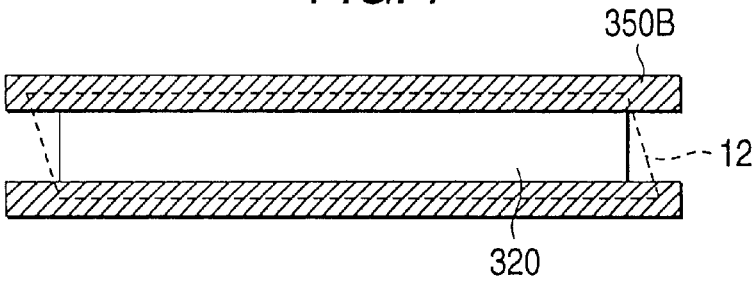
FIG. 7 is a plan showing a transformed example of the second embodiment of the present invention.

The pattern of the lower electrode film removed part is not limited to that in the above example and for example, as shown in FIG. 7, a lower electrode film removed part 350B may be also formed outside both ends of the piezoelectric active part 320 in the longitudinal direction.

Figure 8:
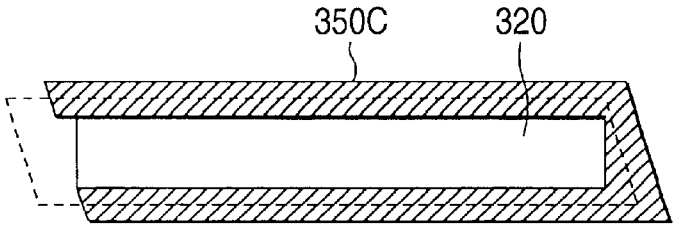
FIG. 8 is a plan showing another transformed example of the second embodiment of the present invention.

Also, for example, as shown in FIG. 8, a lower electrode film removed part 350C may be also provided in the shape of a letter U along the periphery in three directions except one end of the pressure generating chamber 12.

Other Embodiment

Each embodiment of the present invention is described above, however, the basic constitution of the ink-jet recording head is not limited to the above constitution.

For example, in the above embodiments, the nozzle aperture 17 is provided in a direction perpendicular to the surface of the passage forming substrate 10, however, a nozzle aperture 17 may be also formed so that it is formed on the end face of the passage forming substrate 10 and ink is jetted in a direction parallel to the surface.

The example in which the insulating layer is provided between the piezoelectric element and the lead electrode is described above, however, the present invention is not limited to this, for example, an anisotropic conductive film may be also thermically welded to each upper electrode film without providing an insulating layer, the anisotropic conductive film may be also connected to a lead electrode and may be also connected using various bonding technique such as wire bonding.

As described above, the present invention can be applied to an ink-jet recording head with various structure unless the object is violated.

As described above, the ink-jet recording head according to the present invention can be favorably used for an ink-jet recording device for recording a character and image information using ink on a recording medium such as paper, metal, resin and cloth, Further, the ink-jet recording head according to the present invention is optimum as a small-sized high-density ink-jet recording head in which improved characteristics are made the most of and which is used for a small-sized ink-jet recording device provided with high performance.

What is claimed is:

1. An ink jet recording head, comprising:

plural ink chambers included inside a substrate and respectively partitioned by side walls;

a diaphragm which is formed on a surface of said substrate, wherein said diaphragm seals one side of said ink chambers and at least an upper surface of said diaphragm acts as a lower electrode; and a piezoelectric active part provided with a piezoelectric film arranged on said diaphragm corresponding to said ink chamber and an upper electrode formed on said piezoelectric film wherein:

said diaphragm is constituted as a laminated film provided with at least two layers of a layer with positive stress and a layer with negative stress;

a tension of said diaphragm is one of: substantially zero; and negative; and a sum of a tension of said piezoelectric film and the tension of said diaphragm is positive.

2. An ink-jet recording head, comprising:

plural ink chambers included inside a substrate and respectively partitioned by side walls;

a diaphragm which is formed on a surface of said substrate, wherein said diaphragm seals one side of said ink chambers and a lower electrode is provided on an upper surface of said diaphragm; and a piezoelectric film arranged on said diaphragm corresponding to said ink chamber and held between said lower electrode and said upper electrode, wherein:

said diaphragm is constituted as a laminated film provided with at least two layers of a layer with positive stress and a layer with negative stress;

a tension of said diaphragm is one of: substantially zero; and negative; and a sum of a tension of said piezoelectric film, said upper electrode, and said diaphragm is positive.

3. An ink-jet recording head according to claim 1, wherein:

said diaphragm is provided with a silicon oxide layer formed by oxidizing the surface of a monocrystalline silicon substrate and a metallic layer to be said lower electrode laminated on said silicon oxide layer; and plural ink chambers respectively partitioned by side walls are formed inside said monocrystalline silicon substrate.

4. An ink-jet recording head according to claim 3, wherein:

said metallic layer to be said lower electrode is a platinum layer formed on said silicon oxide layer directly or via an intermediate layer; and relationship between said silicon oxide layer and said platinum layer is as follows:

(thickness of lower electrode film)/(thickness of silicon oxide film)$\leqq$0.5.

5. An ink-jet recording head according to any of claims 1, 2, 3, 4, or 8, wherein:

said diaphragm is provided with a thin film part thinner than said diaphragm in a part corresponding to said piezoelectric active part at least in a part of an area along the periphery of said ink chamber around said piezoelectric active part.

6. An ink-jet recording head according to claim 5, wherein:

said diaphragm is provided with a silicon oxide layer formed by oxidizing the surface of a monocrystalline silicon substrate and a metallic layer to be said lower electrode laminated on said silicon oxide layer; and at least a part in the direction of the thickness of said lower electrode is removed in said thin film part.

7. An ink-jet recording head according to claim 5, wherein:

said thin film part is formed on both sides in the direction of the width of said piezoelectric active part.

8. An ink-jet recording head according to claim 2 wherein:

said diaphragm is provided with a silicon oxide layer formed by oxidizing the surface of a monocrystalline silicon substrate and a metallic layer to be said lower electrode laminated on said silicon oxide layer; and plural ink chambers respectively partitioned by side walls are formed inside said monocrystalline silicon substrate.

9. An ink-jet recording head according to claim 6, wherein: said thin film part is formed on both sides in the direction of the width of said piezoelectric active part.

10. The ink-jet recording head according to claim 1, further including a lower electrode film removed part formed by removing a portion of said lower electrode film in a vicinity of said piezoelectric active part.

11. The ink-jet recording head according to claim 10, wherein said lower electrode film removed part is formed in a U-shape provided along the periphery of said piezoelectric active part.

12. An ink-jet recording head according to claim 1, wherein said piezoelectric film is narrower than a width of said ink chamber.

13. An ink-jet recording head according to claim 2, wherein said piezoelectric film is narrower than a width of said ink chamber.

14. An ink-jet recording head according to claim 1, further including an insulating layer formed so that said insulating layer covers at least a periphery of an upper surface of said upper electrode film and a side of said piezoelectric film.

15. An ink-jet recording head according to claim 2, further including an insulating layer formed so that said insulating layer covers at least a periphery of an upper surface of said upper electrode film and a side of said piezoelectric film.

16. An ink-jet recording head according to claim 14, wherein said insulating layer is provided with electric insulation.

17. An ink-jet recording head according to claim 15, wherein said insulating layer is provided with electric insulation.

18. An ink-jet recording head according to claim 14, wherein said insulating layer is formed by a method of forming a film and reshaping said film by an etching process.

19. An ink-jet recording head according to claim 15, wherein said insulating layer is formed by a method of forming a film and reshaping said film by an etching process.

* * * * *